US008618450B2

(12) United States Patent
Sanna et al.

(10) Patent No.: US 8,618,450 B2
(45) Date of Patent: Dec. 31, 2013

(54) DOMESTIC OVEN AND COOKING PROCESS THAT USES THE SAME

(75) Inventors: Salvatore Sanna, Biandronno (IT); Paolo Crosta, Gavirate (IT); Gianpiero Santacatterina, Sangiano (IT); Nicola Bedetti, Como (IT)

(73) Assignee: Whirlpool Corporation, Benton Harbor, MI (US)

( * ) Notice: Subject to any disclaimer, the term of this patent is extended or adjusted under 35 U.S.C. 154(b) by 1500 days.

(21) Appl. No.: 10/596,196

(22) PCT Filed: Dec. 3, 2004

(86) PCT No.: PCT/EP2004/053267

§ 371 (c)(1),
(2), (4) Date: Mar. 7, 2007

(87) PCT Pub. No.: WO2005/055670

PCT Pub. Date: Jun. 16, 2005

(65) Prior Publication Data

US 2007/0241099 A1 Oct. 18, 2007

(30) Foreign Application Priority Data

Dec. 4, 2003 (IT) ..... VA03A0046

(51) Int. Cl.
*H05B 1/02* (2006.01)

(52) U.S. Cl.
USPC ..... 219/506; 219/702; 219/704; 99/325

(58) Field of Classification Search
USPC ..... 219/506, 702, 704, 707, 708, 719; 99/325, 333, 468, 486
See application file for complete search history.

(56) References Cited

U.S. PATENT DOCUMENTS

| | | | | |
|---|---|---|---|---|
| 4,097,707 | A | 6/1978 | Kobayashi et al. | |
| 4,154,855 | A | 5/1979 | Buck | |
| 4,335,293 | A * | 6/1982 | Kobayashi et al. | 219/707 |
| 4,463,238 | A * | 7/1984 | Tanabe | 219/685 |
| 5,558,797 | A * | 9/1996 | Takagi | 219/705 |
| 5,698,126 | A | 12/1997 | Morita et al. | |
| 6,065,391 | A * | 5/2000 | Archard et al. | 99/342 |
| 6,538,240 | B1 * | 3/2003 | Shon et al. | 219/707 |
| 2003/0139843 | A1 * | 7/2003 | Hu et al. | 700/211 |

FOREIGN PATENT DOCUMENTS

EP 1424874 A 6/2004

* cited by examiner

*Primary Examiner* — Brian Jennison

(57) ABSTRACT

A domestic oven comprises heating means, a gas sensor connected to a central processing and control unit and a user interface connected to the central processing unit by means of which the user can set the type of food placed in the oven compartment. The user interface comprises means for setting the desired degree of cooking of the food and is capable of processing the signal of the gas sensor in such a way as to determine the optimal cooking end time of the food. The central processing unit interrupts the electrical supply to the heating means on the basis either of said cooking end time, modified if necessary on the basis of degree of cooking set by the user, or of the food type set by the user.

12 Claims, 4 Drawing Sheets

DOMESTIC OVEN AND COOKING PROCESS THAT USES THE SAME

CROSS-REFERENCE TO RELATED APPLICATIONS

This application claims priority on International Application No. PCT/EP2004/053267, filed Dec. 3, 2004, which claims priority on Italian Application No. VA2003A000046 filed Dec. 4, 2003.

The present invention concerns a domestic oven of the type comprising heating means, a gas sensor connected to a central processing and control unit and a user interface connected to said central processing unit by means of which the user can set the type of food placed in the oven compartment. The present invention also concerns a cooking process that uses the aforesaid oven.

Such a type of known oven is described for example in U.S. Pat. No. 4,331,855 and U.S. Pat. No. 4,463,238. Said ovens with one or more gas sensors have been designed in order to make it simpler to use domestic ovens in which, traditionally, methods for setting the cooking time are based mainly on recipes and not on the actual process for cooking the food.

The aim of the present invention is, by monitoring the gases emitted by the food during cooking, to provide an oven that makes it possible to understand and therefore to communicate to the user the actual degree of cooking of the food (well cooked, lightly cooked, over-cooked, becoming burnt) and, if necessary, to interact with the control of said oven with the aim of automatically achieving a desired cooking level, at the same time preventing the food from burning.

This aim is achieved by means of an oven having the characteristics specified in the attached main claim.

According to another characteristic of the present invention, the gas sensor is positioned in an optimal configuration, i.e. placed in the intake duct of the oven. Positioning the sensor correctly is not in fact easy, since it is exposed to dirt from the oven and to the high cooking temperatures of foods. The position of the sensor also significantly influences the type of signal supplied by said sensor. The above-mentioned position has been found to be optimal. The invention involves the use of a gas sensor of MOS type (Metal Oxide Semiconductor), already used for automatic cooking in some microwave ovens. It should be understood that other types of sensors, for example MOSFET (Metal Oxide Semiconductor Field-Effect) could be used.

The signal from the gas sensor is subject to pre-filtering through a filter with characteristics (bandwidth, attenuation, phase, etc.) depending on the food type. As a consequence of this operation, the signal is analysed with the aim of demonstrating some characteristics that can be correlated with the cooking of the food.

Further advantages and characteristics of an oven according to the present invention will be obvious from the following detailed description, supplied purely as a non-limitative example, with reference to the attached drawings in which.

With reference to the drawings, the reference number 10 is used to indicate the sensor positioned inside a duct C of an oven F; the cooking vapours that leave via the duct C therefore pass through the sensor.

This solution makes it possible for the sensor not to be directly exposed to the cooking gases and therefore not to be soiled by any fat splashes; at the same time it will be subject to lower temperatures than if it were positioned inside the oven. This positioning ensures that the distance from the food is a fair compromise between the solution in which the sensor is placed immediately next to the food (inside the compartment) and that in which it is placed in a suitable chamber outside the compartment and connected by means of suitable tubing. The gas sensor used in the tests carried out by the applicant is sensor model ST-MW2 produced by FIS.

Figure 1:
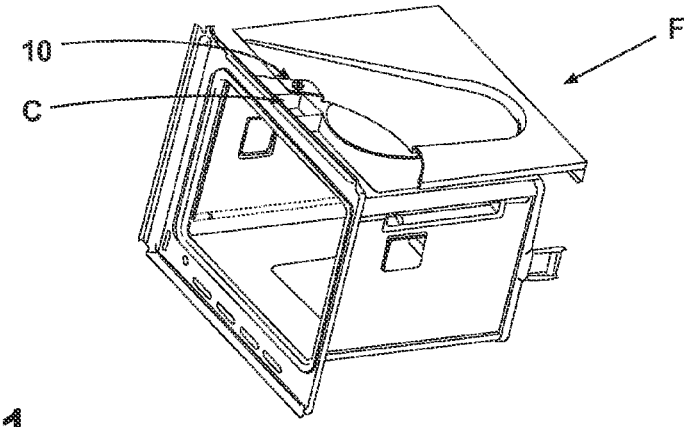
FIG. 1 is a perspective view of an oven according to the invention.
Figure 2:
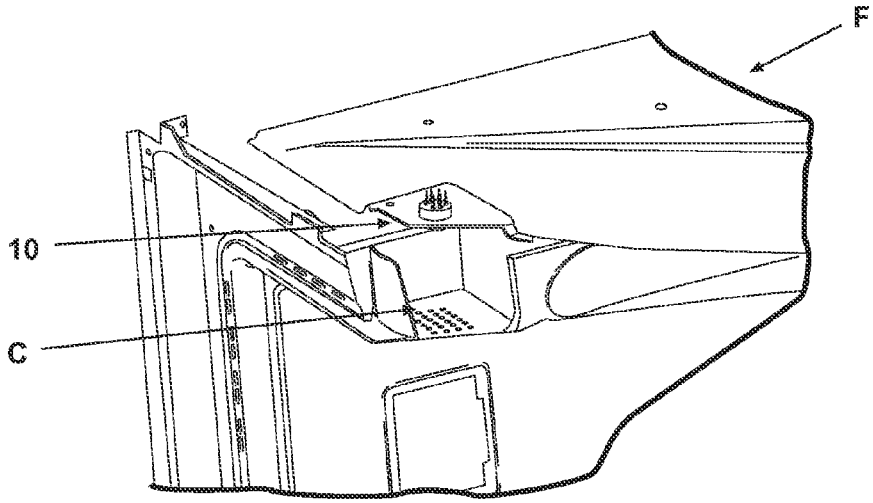
FIG. 2 is a detail on a larger scale of FIG. 1.
Figure 3:
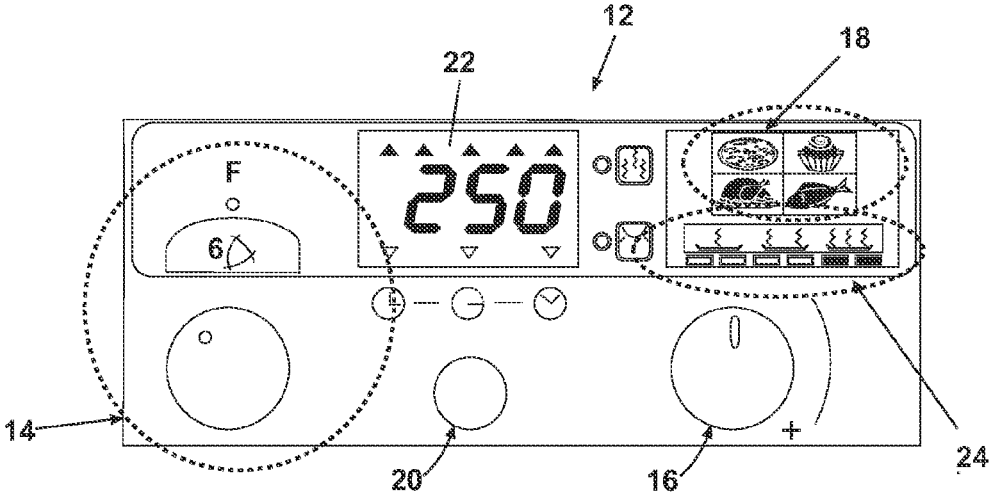
FIG. 3 is a front view of the user interface of the oven in FIG. 1.

According to the invention, the oven F is provided with a user interface 12 (FIG. 3), with which to set either the automatic cooking function, by means of a knob 14, or the category of food that is to be cooked (pizza, lasagna, chicken, etc.). The food type can be set by means of a selection knob 16. In this case, in the configuration where the food type is set, zones 18 will be shown corresponding to the food category and the user will have to confirm the choice by means of an appropriate push-button 20. Alternatively, the food type can be set by acting directly on the zones 18, shaped like push-buttons, for example of the "touch-control" type (i.e. with no moving parts). The user interface 12 also has a conventional zone 22 for displaying the operating conditions of the oven (temperature, function set etc.) and an innovative zone 24 by means of which the user can set and display the degree of cooking of the food (lightly cooked, normal, well cooked). Said user interface 12 can therefore provide an indication of the cooking level, since each cooking level is associated with a different display. Obviously, the way that the cooking level is illustrated can differ from that illustrated in FIG. 3 and can, for example, use LED bars (light-emitting diodes) of different colours. When the associated LED is illuminated this indicates, for example, that the food is raw, lightly cooked, cooked, well cooked or burnt.

Figure 4:
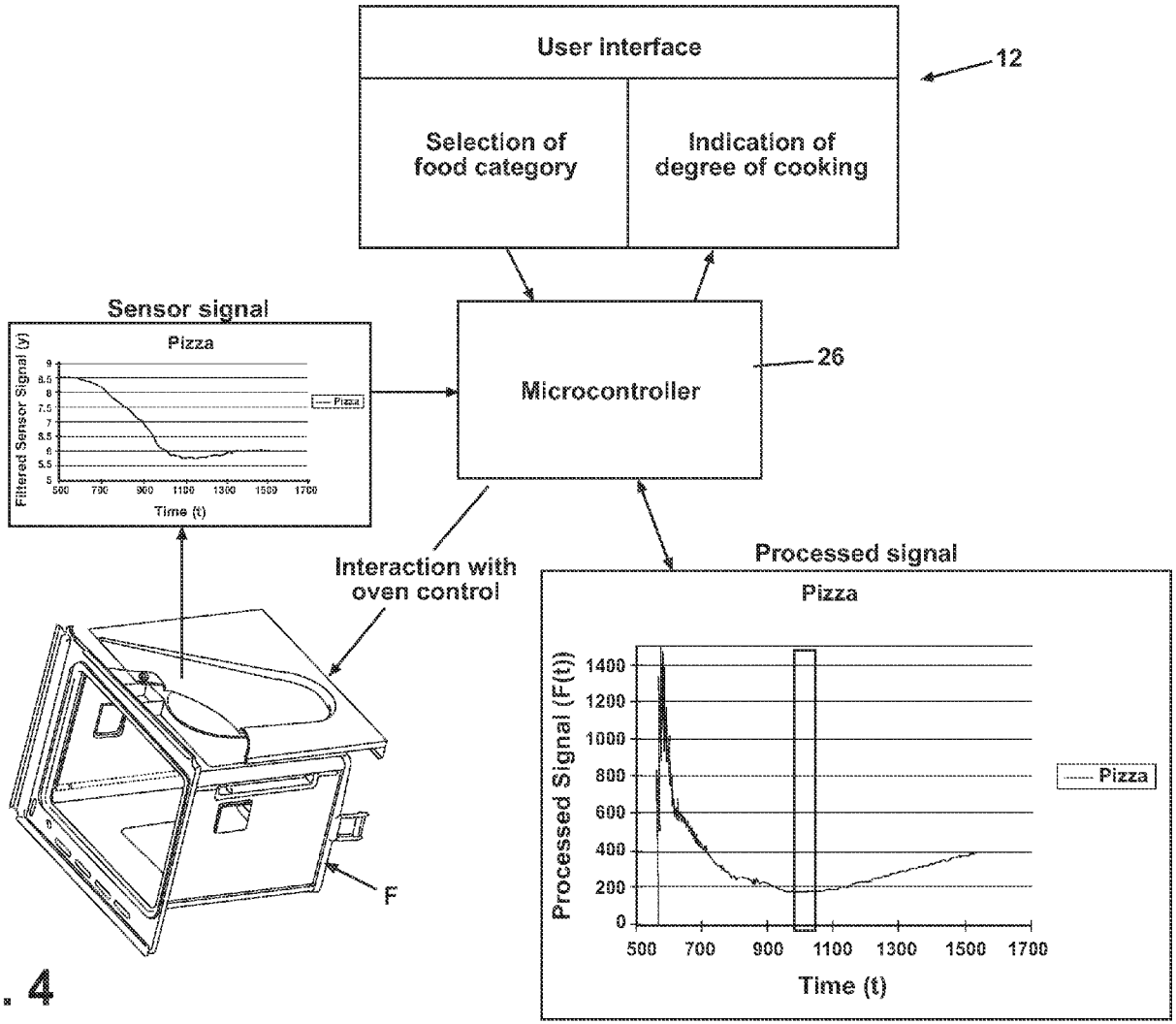
FIG. 4 is a block diagram of the logic for connecting the oven, gas sensor, user interface, microcontroller.

FIG. 4 illustrates diagrammatically the control circuit of the oven controlled by a microprocessor 26 connected to the gas sensor and to the user interface 12. The heating elements of the oven, like other components (fans, thermostats etc.) are not illustrated, but in any case they are also managed by the microprocessor 26.

Figure 5:
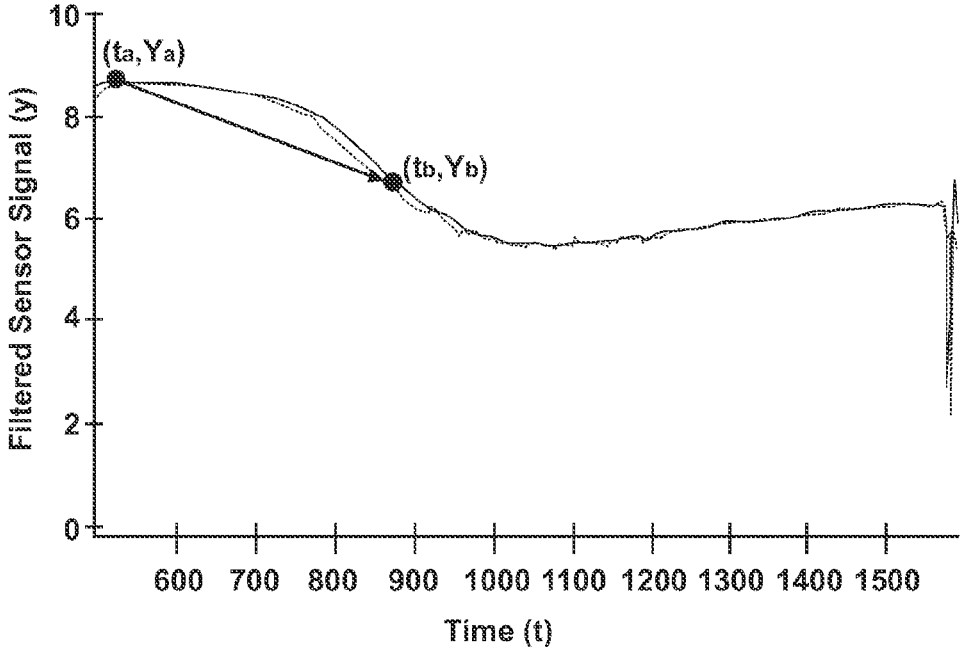
FIG. 5 is a diagram illustrating the variation in the signal of the gas sensor in a particular cooking process in the oven in FIG. 1.
Figure 6:
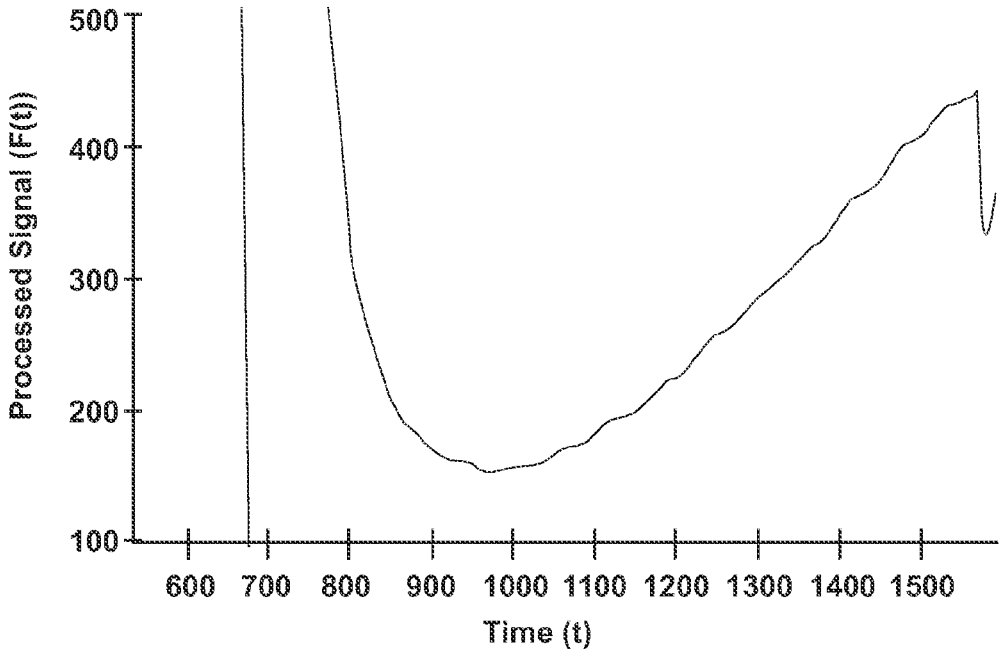
FIG. 6 is a diagram illustrating the course of the signal after suitable processing by the central processing unit of the oven.
Figure 7:
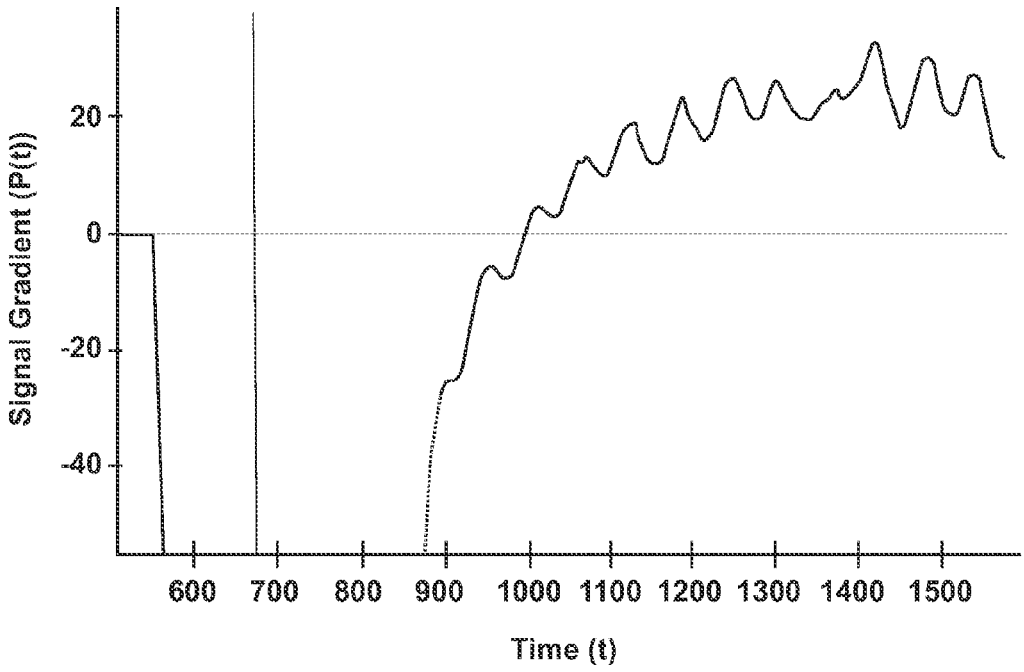
FIG. 7 is a diagram illustrating the course of the gradient of the function shown in FIG. 6.

FIG. 5 illustrates the electrical signal of the sensor and FIG. 6 the processing of said signal in the case, for example, of cooking a pizza.

The processing of the signal provides first of all for the signal to be filtered. Once the signal is obtained from the sensor 10, by sampling at homogeneous intervals equal, for example, to 1 second, pre-filtering has to be applied to it. Good results have been achieved by applying a moving-window filter with an amplitude equal to 30 samples. The amplitude of filtering depends on the food type being considered. This filtering algorithm can be replaced by other methods.

As concerns the chosen moving-window filter, its output at the "ith" moment depends on the samples acquired within the time interval preceding said ith moment and with dimensions equal to the amplitude of the filter, in the case cited, therefore, equal to 30 samples:

$$Y_i(T_i) = \sum_{j=1}^{i-n} \frac{\hat{Y}j}{n}$$

Ŷj
where
is the actual signal at the moment Tj.

FIG. 5 shows the course of the signal from the filtered sensor where a pizza is being cooked. Said diagram illustrates a vector with the origin (ta, Ya) and the vertex (tb, Yb) lying over the prefiltered signal. The origin of the vector is chosen in correspondence with the moment when the food is placed in the oven. The vertex describes, moment by moment, the evolution of the prefiltered signal. While the origin of the vector is therefore a point chosen and fixed at the beginning of the algorithm, the vertex moves according the evolution of the signal through time.

By processing the signal Y we get the following signal F(t):

$$F(t) = \frac{(t_a - t_b)^{\alpha}}{(Y_a - Y_b)^{\beta}}$$

illustrated in FIG. 6 where a and β are equal to 1.

α and β can assume values other than 1 and can be obtained by experimentation in relation to the food type placed in the oven compartment.

The processed signal produced in this way reaches its minimum in a period of time when the food (pizza in the example described) is being cooked, and the gradient of this signal indicates the degree of cooking. A formula for evaluating the gradient can for example be:

$$P(t) = \frac{F(t) - F(t - 40\text{ sec})}{K}$$

where K is a constant other than zero.

If P(t) supplies negative values, the function F(t) has a negative gradient as a result and this coincides with the phases prior to the optimal cooking moment. If P(t) takes values close to zero we are close to optimal cooking, i.e. to the minimum of the function F(t). Assuming that P(t) has highly positive values, there is an indication of a very advanced or burnt state of cooking.

By way of example, taking the constant K to be equal to 1, the following experimental intervals are obtained for cooking the pizza:

| | |
|---|---|
| Raw: | P(t) < −60 & P(t) > 60 |
| Lightly cooked: | −60 < P(t) < −10 |
| Cooked: | −10 < P(t) < 5 |
| Well cooked: | 5 < P(t) < 15 |
| Burnt: | P(t) > 15 & P(t) < 60 |

The invention claimed is:

1. A domestic oven comprising:

an oven compartment for receiving food;

a heating element to heat the oven compartment for cooking food;

a gas sensor in fluid communication with the oven compartment and outputting a signal indicative of the gases emitted by food being cooked in the oven compartment;

a central processing unit operably coupled to and controlling the heating element;

a user interface operably coupled with the central processing unit and configured to display a setting for a type of food placed in the oven compartment and to display a setting for a desired degree of cooking such that a user can set the type of food placed in the oven compartment and set the desired degree of cooking of the food; and wherein the central processing unit is configured to receive a gas sensor signal, the food type, and the desired degree of cooking, and controls the operation of the heating element to cook the food for a cooking interval until the desired degree of cooking is reached, with a current degree of cooking being determined by filtering the signal from the gas sensor, with an amplitude of filtering selected by the central processing unit depending on the type of food set by the user.

2. The domestic oven of claim 1 wherein the central processing unit is further configured to determine the cooking interval as a function of the signal received from the gas sensor, a temperature of the oven compartment and a control algorithm for the oven.

3. The domestic oven of claim 1 wherein the central processing unit is further configured to determine a gradient of the signal, and wherein the determined gradient is compared with predetermined values stored in the central processing unit for determining the current degree of cooking.

4. The domestic oven of claim 1 further comprising a duct fluidly coupled with the oven compartment and wherein the gas sensor is located inside the duct.

5. A method for automatic cooking in a domestic oven having an oven compartment for receiving food, a heating element to heat the oven compartment to cook the food in the oven compartment, and a central processing unit for controlling the heating element to cook the food, the method comprising:

receiving as input to the central processing unit a setting of a food type of the food in the oven compartment;

receiving as input to the central processing unit a setting of a desired degree of cooking of the food in the oven compartment;

receiving as input to the central processing unit a signal indicative of gas emitted by the food being cooked in the oven compartment from a gas sensor in fluid communication within the oven compartment;

the central processing unit filtering the signal from the gas sensor for the set food type according to a function of the type:

$$F(t) = \frac{(t_a - t_b)^{\alpha}}{(Y_a - Y_b)^{\beta}}$$

where $Y_a$ and $Y_b$ are values indicative of the signal from the gas sensor at a time $t_a$ and $t_b$, respectively, and α and β are coefficients obtained experimentally for the set food type;

the central processing unit determining a gradient of the function F(t);

the central processing unit determining a cooking interval for the food as a function of the degree of cooking and the determined gradient of the function F(t); and operating the heating element for the cooking interval to cook the food to the desired degree of cooking.

6. The method of claim 5 further comprising modifying a cooking interval as a function of a degree of cooking of the food set by a user.

7. The domestic oven of claim 1, wherein the user interface is configured to display the current degree of cooking of the food.

8. The domestic oven of claim 1, wherein the user interface is configured to display an indication of the cooking level of the food.

9. A domestic oven comprising:

an oven compartment for receiving food;

a heating element to heat the oven compartment for cooking food;

a gas sensor in fluid communication with the oven compartment and outputting a signal indicative of the gases emitted by food being cooked in the oven compartment;

a central processing unit operably coupled to and controlling the heating element;

a user interface operably coupled with the central processing unit and configured to display the current degree of cooking, a setting for a type of food placed in the oven compartment, and a setting for a desired degree of cooking such that a user can set the type of food placed in the oven compartment and set the desired degree of cooking of the food;

wherein the central processing unit is configured to receive a gas sensor signal, the food type, and the desired degree of cooking, and controls the operation of the heating element to cook the food for a cooking interval with a current degree of cooking being determined by filtering the signal from the gas sensor, with an amplitude of filtering selected by the central processing unit depending on the type of food set by the user.

10. The domestic oven of claim 9, wherein the user interface is configured to display at least three levels of desired degree of cooking.

11. The domestic oven of claim 9, wherein the user interface is configured to display at least three levels of current degree of cooking.

12. A domestic oven comprising:

an oven compartment for receiving food;

a heating element to heat the oven compartment for cooking food;

a gas sensor in fluid communication with the oven compartment and outputting a signal indicative of the gases emitted by food being cooked in the oven compartment;

a central processing unit operably coupled to and controlling the heating element;

a filter operably coupling the gas sensor to and controlled by the central processing unit;

a user interface operably coupled with the central processing unit and configured to display a setting for a type of food placed in the oven compartment and to display a setting for a desired degree of cooking such that a user can set the type of food placed in the oven compartment and set the desired degree of cooking of the food; and wherein the central processing unit is configured to receive a gas sensor signal, the food type, and the desired degree of cooking, and controls the operation of the heating element to cook the food for a cooking interval until the desired degree of cooking is reached, with a current degree of cooking being determined by filtering the signal from the gas sensor, with an amplitude of filtering selected by the central processing unit depending on the type of food set by the user.

* * * * *